US006142158A

United States Patent [19]

Lloyd et al.

[11] Patent Number: 6,142,158

[45] Date of Patent: Nov. 7, 2000

[54] INTERCHANGEABLE BARRETTE ASSEMBLY WITH ORNAMENTAL COMPONENT

[76] Inventors: Lisa Lloyd, 7465 E. Milagro Ave., Mesa, Ariz. 85208; Jose Pepé Elijio Velasquez, 102 E. 15th St., Tempe, Ariz. 85281

[21] Appl. No.: 08/713,679

[22] Filed: Sep. 17, 1996

[51] Int. Cl.[7] ..... A45D 8/20

[52] U.S. Cl. ..... 132/275; 24/462; 24/16 PB; 132/278

[58] Field of Search ..... 132/273, 275, 132/276, 278, 279, 277; 24/461, 462, 459, 16 PB; 63/1.1, 2

[56] References Cited

U.S. PATENT DOCUMENTS

| | | | |
|---|---|---|---|
| 4,753,252 | 6/1988 | Boxer | 132/278 |
| 4,991,607 | 2/1991 | Chen | 132/278 |
| 5,018,253 | 5/1991 | Oppenheimer | 24/459 |
| 5,398,705 | 3/1995 | Hiltbrand et al. | 132/273 |
| 5,524,651 | 6/1996 | Young et al. | 132/275 |

FOREIGN PATENT DOCUMENTS

| | | | |
|---|---|---|---|
| 48611 | 11/1986 | Germany | 132/278 |
| 209705 | 7/1940 | Switzerland | 132/275 |

*Primary Examiner*—Todd E. Manahan
*Assistant Examiner*—Eduardo C. Robert
*Attorney, Agent, or Firm*—Halvorson & Venable, P.C.

[57] ABSTRACT

The present invention relates to hair barrettes. More specifically, hair barrettes with removable clasps. The removable clasps may be attached to the barrette by a variety of different structure, including direct attachment and attachment through an intermediate universal adapter. The universal adapter allows the clasp to remain in the hair while simultaneously exchanging the ornamental component of the hair barrette. Furthermore, the universal adapter allows interchange of parts such that any size clasp may be used with any of the receiving ornamental components.

9 Claims, 10 Drawing Sheets

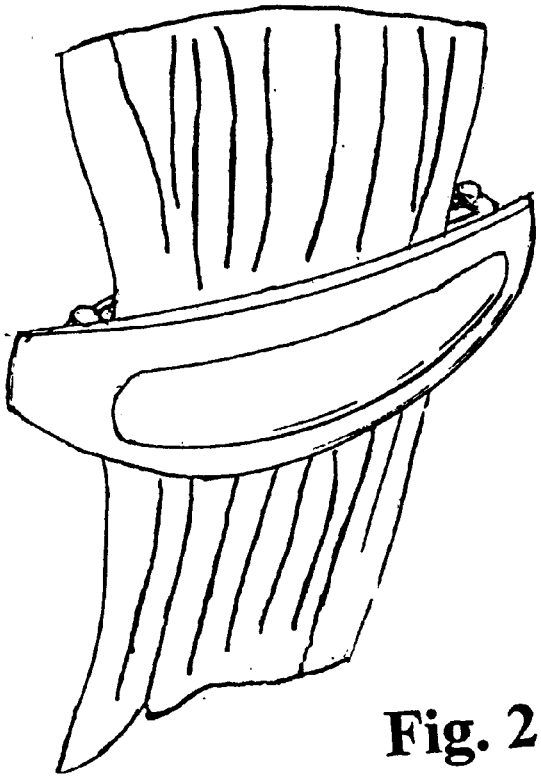
Fig. 2
Fig. 3
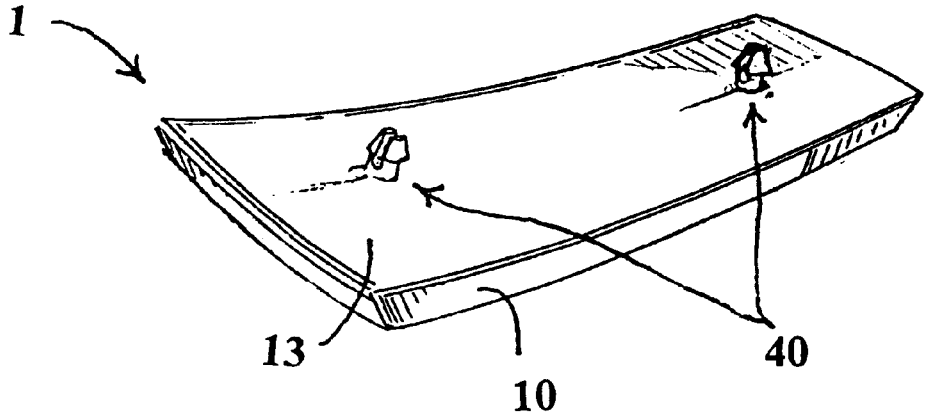

Fig. 4
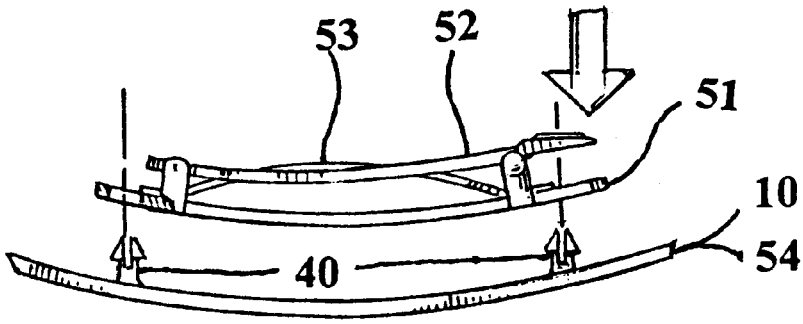
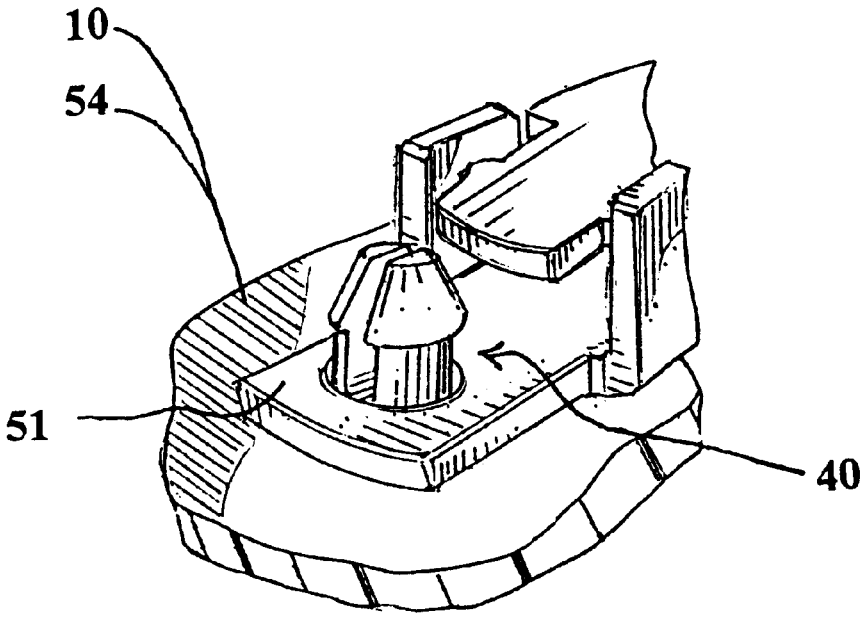
Fig. 6

INTERCHANGEABLE BARRETTE ASSEMBLY WITH ORNAMENTAL COMPONENT

FIELD OF THE INVENTION

The invention relates generally to personal jewelry, and more particularly an interchangeable barrette assembly wherein a unique removable interconnection, between an individual barrette ornament and a clasp, enhances the barrette's utility. The invention will specifically disclose a novel construction for the interchangeable barrette assembly which can be worn by a person in their hair, and a method for making the barrette.

BACKGROUND

There are numerous hair styles that may be worn by people with long hair. A large fraction of these hair styles are accomplished with ornamental accessories that hold at least a portion of the hair in a particular configuration. Barrettes are a common accessory for hair styles.

A typical barrette is of unitary construction with a clasp, normally a metallic two piece hinged clip, permanently imbedded or attached to an ornamental section. Another form has the ornamental section act in concert with a semi-flexible metal wire to form a clasp. Damage to either the ornamental component or the clasp renders the barrette undesirable or unusable, and the entire assembly will therefore be discarded.

Other barrettes feature removable clasps. Removable clasps allow the reuse of either the ornamental portion or the clasp in the event the other part is damaged. Additionally, a wide variety of ornamental sections may then be used and reused with identical sets of clasps, thereby providing a wider variety of designs for a person's hair style. In the past, removable clasps have been attached to the ornamental component with strings or screws. While providing an effective attachment means, these methods do not allow the ornamental components to be exchanged while the clasp is in use.

It would be useful to have an easy-to-use interconnection system which facilitates the exchange of the ornamental feature while simultaneously maintaining the hair style.

SUMMARY OF THE INVENTION

One of the purposes of the present invention is to provide an interchangeable barrette assembly. This interchangeable barrette assembly comprises at least two parts, an ornamental component and a clasp.

It is another purpose of the present invention to provide an interchangeable barrette assembly which utilizes a removable clasp portion. The clasp in the removable clasp portion may be of any of the different clasp sizes and still be used in conjunction with the ornamental component.

It is still another purpose of the present invention to provide an interchangeable barrette assembly with which the user may change the ornamental component without disrupting the configuration of the hair style.

It is yet another purpose of the present invention to provide a removable clasp that snaps into a corresponding indentation located on the back surface of the ornamental component, said removable clasp secured by a pair of opposing posts including overhanging projections to restrict movement.

It is still yet another purpose of the present invention to provide a removable clasp that, once attached to an ornamental component, is removable by a slight flexing of the ornamental component.

It is a further purpose of the present invention to provide a removable clasp that, once attached to an ornamental component, is removable by a slight bending of the pair of opposing posts.

It is yet a further purpose of the present invention to provide a removable clasp that fits into a corresponding indentation located in the back of the ornamental component, and is secured by a pair of rotatable arms.

It is still yet a further purpose of the present invention to provide a removable clasp in which a regular clasp is attached to a universal adapter, which fits into a corresponding indentation located in the back of the ornamental component, by a pair of split tangs that are received in a corresponding pair of apertures normally included in the regular clasp.

It is an additional purpose of the present invention to provide an interchangeable clasp assembly which secures the removable clasp to the ornamental component by receiving a pair of split tangs through a corresponding pair of apertures located in the clasp.

BRIEF DESCRIPTION OF THE DRAWINGS

The above and still further objects, features and advantages of the present invention will become apparent upon consideration of the following detailed description of several specific embodiments, especially when incorporated with the accompanying drawings, wherein:

FIG. 2 is a close-up of the barrette section of the hair style in FIG. 1.

FIG. 3 shows the location of the pair of tangs according to the first preferred embodiment of the present invention;

FIG. 4 illustrates the attachment of the clasp to the ornamental component or universal adapter;

FIG. 6 shows the placement of the clasp once attached by means of the first preferred embodiment;

DESCRIPTION OF PREFERRED EMBODIMENTS

Figure 1:
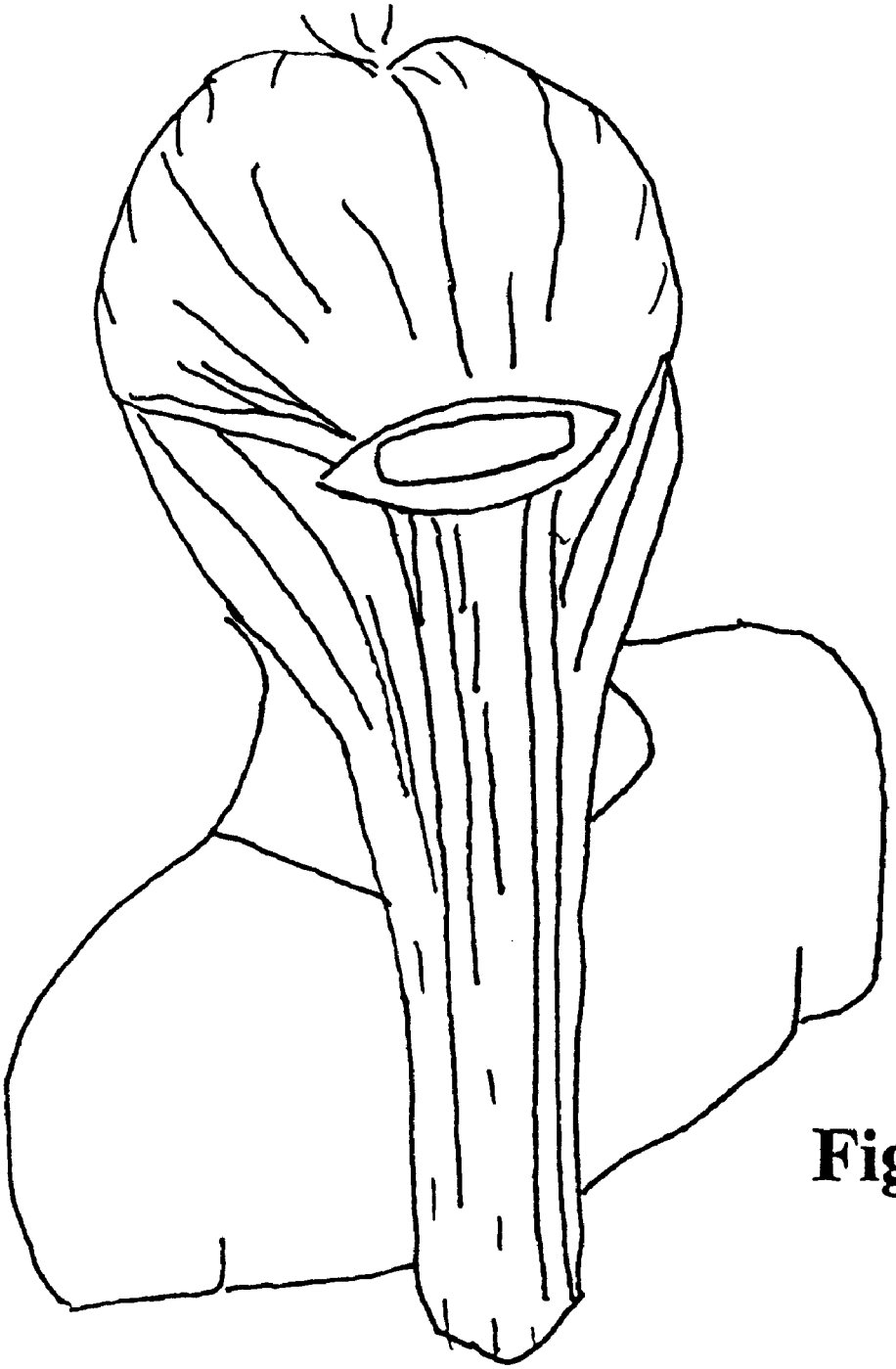
FIG. 1 illustrates a typical hair style using a barrette.
Figure 5:
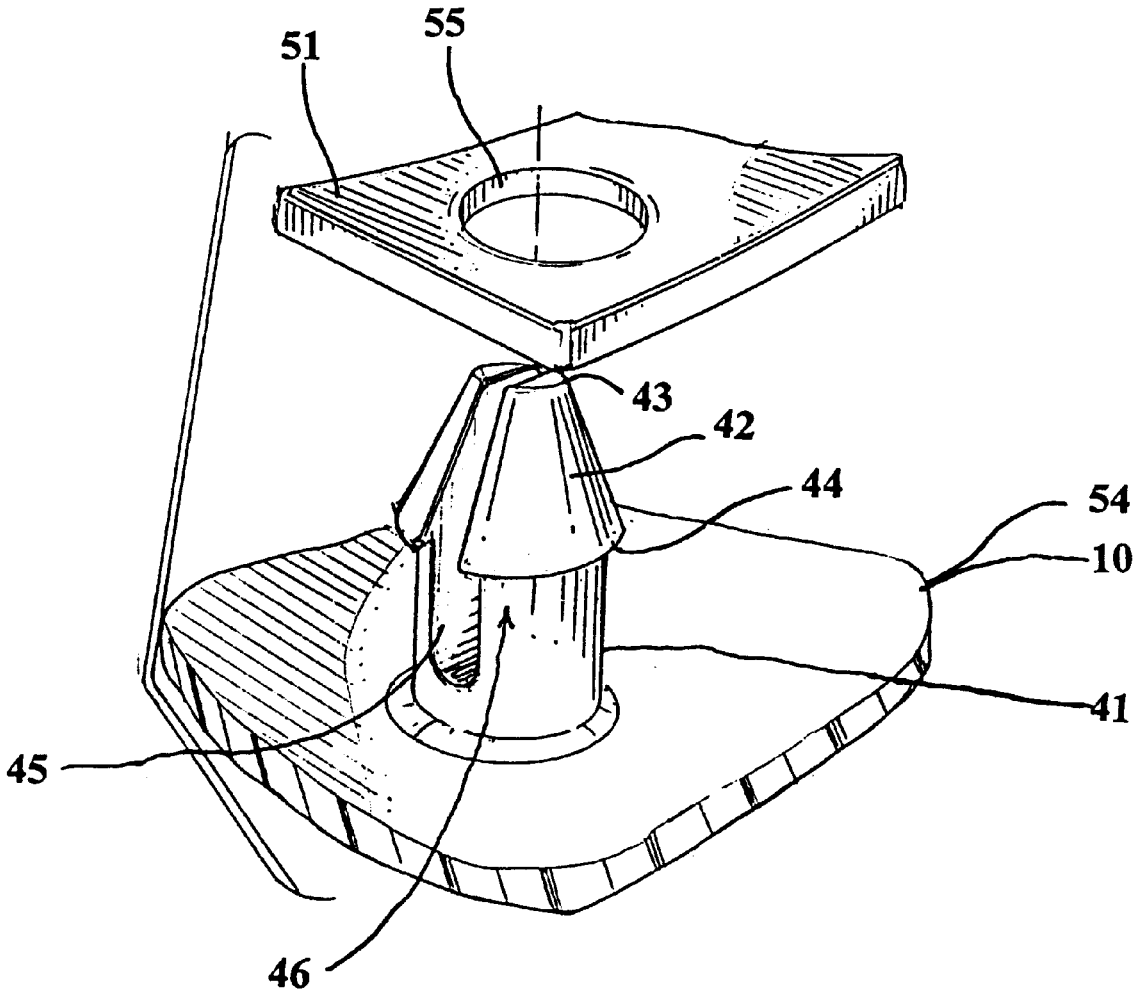
FIG. 5 is a close up of one of the pair of tangs of the first preferred embodiment.
Figure 7:
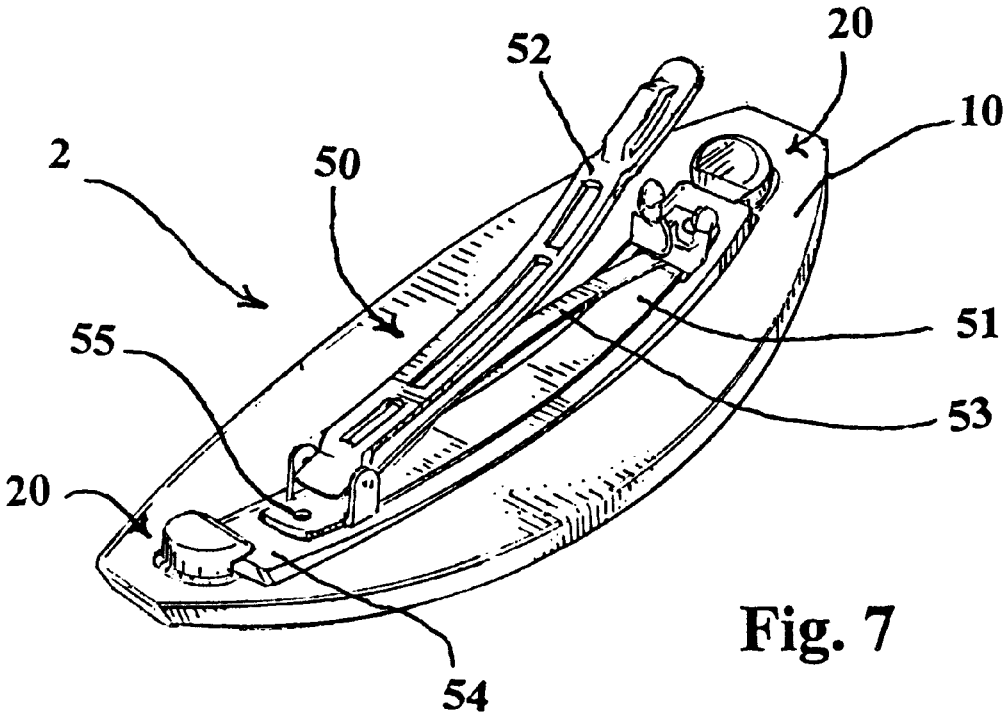
FIG. 7 depicts a second preferred embodiment of the present invention utilizing a pair of posts to secure the clasp to the ornamental component.
Figure 8:
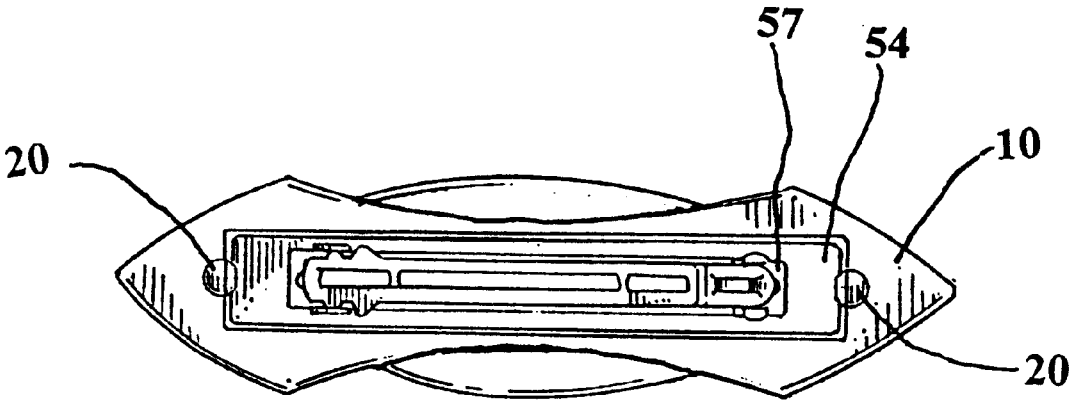
FIG. 8 is a back view of the second preferred embodiment.

Referring now to the drawings, barrettes are frequently used during the realization of hair styles as illustrated in FIG. 1 and shown in greater detail in FIG. 2.

The interchangeable barrette assembly of the present invention is constructed from two primary portions, an ornamental component 10 and a clasp 50 which is removable from the ornamental component 10. While clasp assemblies for hair care are well known in the art, the clasp assembly in the following description of a removable clasp assembly is to be considered for illustrative purposes only. Alternate clasp assemblies are considered encompassed by the present invention.

An ordinary clasp 50, such as a simple hinged bow clasp, as used in the present invention has a first part, or clasp base 51, which is, during normal use, permanently attached to the ornamental component 10 of the barrette. The clasp base 51 is typically a long thin narrow band of metal with a first end and a second end. There are a pair of apertures 55 in the clasp base 51 at opposite ends of the clasp base 51.

A second part of the clasp 50, a flexible bow 52, is pivotally attached at a first end to a first end of the clasp base 51. A second end of the flexible bow 52 releasably attaches to a clasp fastener assembly located at a second end of the clasp base 51. The particular clasp 50 illustrated in the drawings, includes a channel running down the middle of the flexible bow 52.

A third part of the clasp 50, an opposing bow 53, is attached to the clasp base 51 at matching first ends and second ends. The width of the opposing bow 53 is narrow enough to fit inside of the channel located in the flexible bow 52. When the clasp 50 is closed about a portion of a person's hair, the two bows provide a source of pressure that maintains the position of the clasp 50 within the hair style.

Clasps, such as the one described above, are usually produced in three distinct sizes, small, medium and large for differing thickness' of hair.

In a first preferred embodiment 1 of the present invention, the clasp 50 is removably attached to an ornamental component 10. The ornamental component 10 may be a simple piece of rectangular plastic or it may be more complex ornamentation.

The releasable means of attaching the ornamental component 10 to the clasp 50, in the first preferred embodiment, is a pair of tangs 40 projecting from a back surface 13 of the ornamental component 10. The pair of tangs 40 are spaced and coaxially positioned on the back surface 13 relative to the pair of apertures 55 located in the clasp base 51. Thus the pair apertures 55 receive the tangs 40 on the back surface 13 and secure the clasp 50 to the ornamental component 10.

The pair of tangs 40 are simple in construction and comprise a cylindrical body section 41 and a frustro-conical cap section 42 with a small diameter upper end 43 and a large diameter lower end 44. The diameter of the lower end 44 is larger than the body section 41 diameter thereby providing an overhanging retention section 46, while the diameter of the body section 41 is slightly less than the diameter of the pair of apertures 55. The diameter of the lower end 44 is slightly larger than the diameter of the pair of apertures 55. Therefore, the clasp base 51 can be forced down over the frustro-conical cap section 42, and the retention section 46 prevents accidental separation of the ornamental component 10 from the clasp base 51. Since the diameter of the lower end 44 of the frustro-conical cap section 42 is slightly larger than the diameter of the pair of apertures 55, the clasp base 51 may be separated from the ornamental component 10 by an upward force sufficient to deform the lower end 44 of the frostro-conical cap section 42. Preferably, though, the pair of tangs 40 are split into two halves by a channel 45. The channel 45 eases the removal of the clasp 50 from the ornamental component 10. Pinching the two halves of each tang 40 together brings the retention section 46 into the diameter of the pair of apertures 55 and the clasp 50 is easily removed from the ornamental component 10.

A universal adapter 54 may also be attached to the clasp 50 by a pair of tangs 40 as described above in the first preferred embodiment 1. The universal adapter 54 is a long thin substantially arcuate component made of plastic. The universal adapter 54 allows a variety of ornamental components to be used with removable clasps 50 regardless of clasp size, as will be further described below.

It must be recognized that in the following description of the various structures used to secure the universal adapter 54 to the ornamental portion 10 that the clasp 50 may also be attached to the universal adapter 54 by other means, even permanent means, and still fall within the scope of the present invention.

In a second preferred embodiment 2, the ornamental component 10 comprises a body section 11 with a front surface 12 and a back surface 13. The front surface 12 of the ornamental component 10 is the section normally in view when the barrette is used in a hair style. Located on the back surface 13 is a centralized longitudinal indentation 14. Located at opposite ends of the indentation 14 are a pair of posts 20 for securing the universal adapter 54, and therefore the removable clasp 50 to the ornamental component 10.

Figure 9:
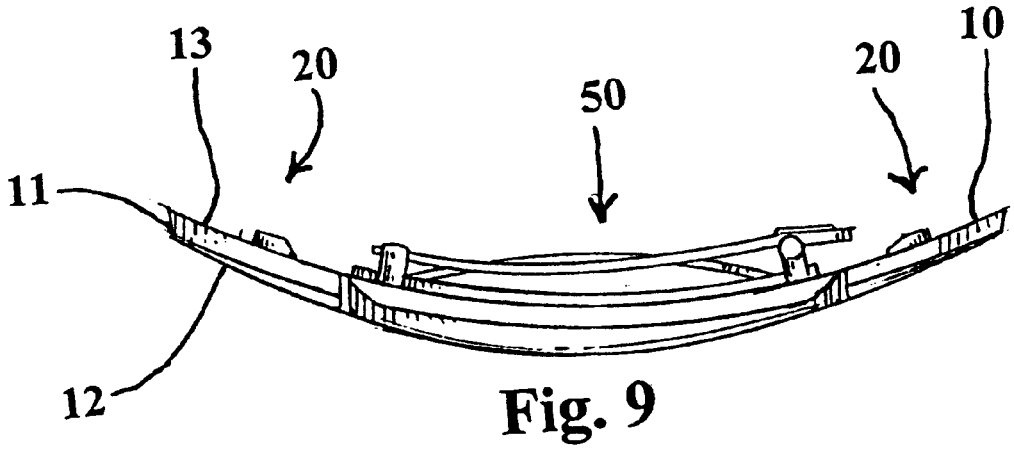
FIG. 9 is a side view of the second preferred embodiment illustrating a flush universal adapter.
Figure 10:
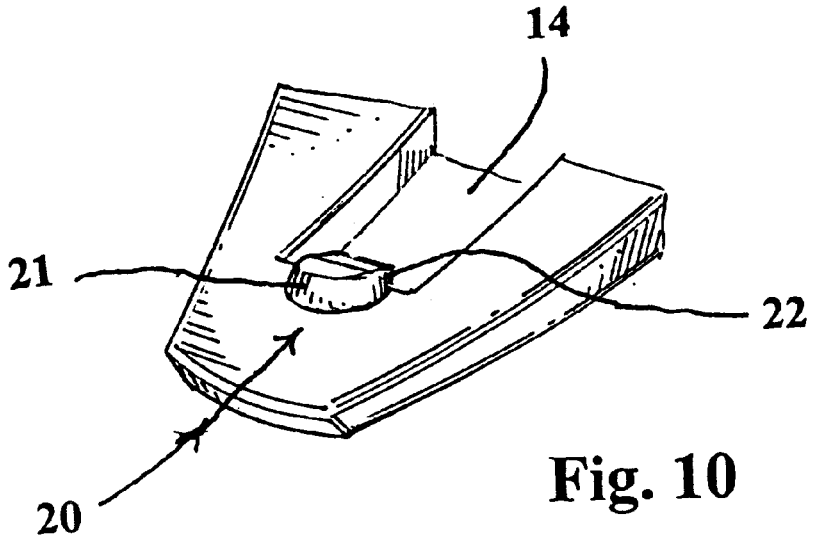
FIG. 10 is a close up view of one end of the second preferred embodiment.
Figure 12:
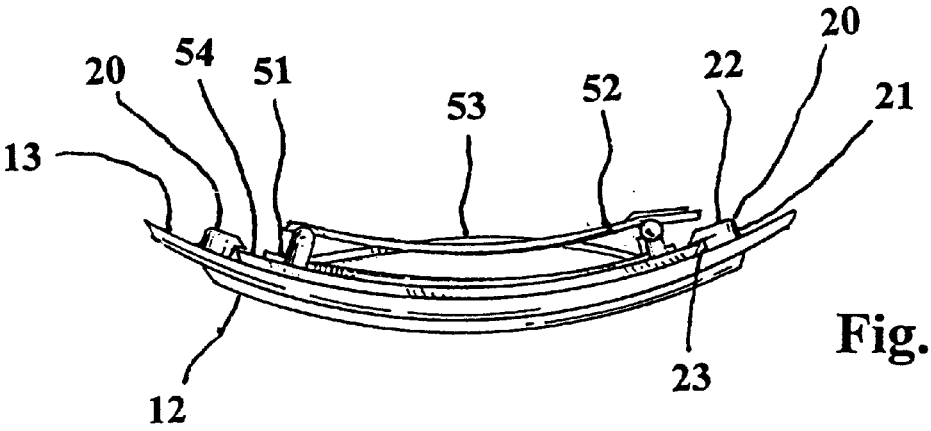
FIG. 12 is a side view of the second preferred embodiment illustrating a projecting universal adapter.
Figure 13:
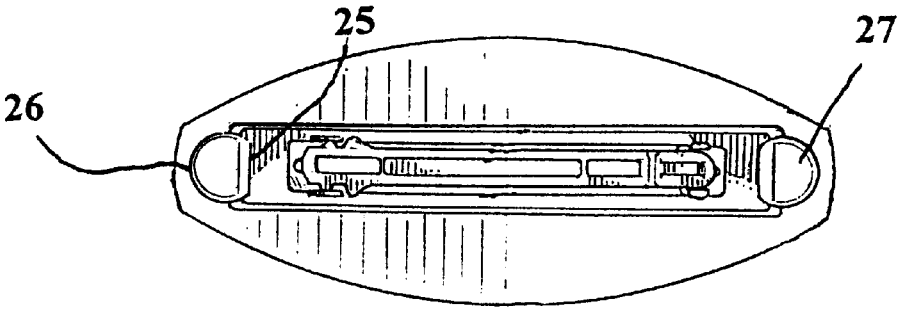
FIG. 13. is a view of the present invention with depicting a larger pair of posts.
Figure 14:
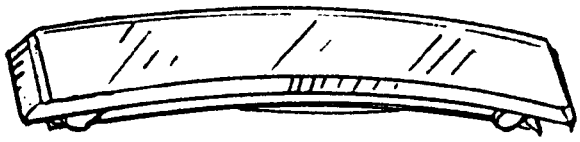
FIG. 14 is a top view of the universal adapter of the present invention.

The indentation 14 located in the back surface 13 of the body section 11 of the ornamental component 10 is sized to receive the universal adapter 54. The depth of the indentation 14 may be less than the thickness of the universal adapter 54, and therefore the universal adapter 54 projects slightly above the surface of the back surface 13 of the ornamental component 10 as illustrated in FIG. 12 or may be flush with the ornamental component 10 as illustrated in FIG. 9. While the indentation 14 may be considerably larger in outline than the universal adapter 54 of the removable clasp 50, a close match is preferable, thereby providing a snug fit and preventing unwanted movement of the ornamental component 10 of the barrette.

The pair of posts 20 of the second preferred embodiment 2 are specially designed to work with the universal adapter 54 of the present invention and have a body section 21 and a cap section 22. The body section 21 of the pair of posts 20 are D-shaped, with a flat side surface 23 and a curved side surface 24. The cap section 22, also D-shaped with a flat side surface 25 and a curved side surface 26, is larger than the body section 21 and projects over the flat surface 23 of the body section 21, thereby creating a projection part. The flat side surface 25 of the cap section 22 may be beveled toward a cap top surface 27.

Figure 11:
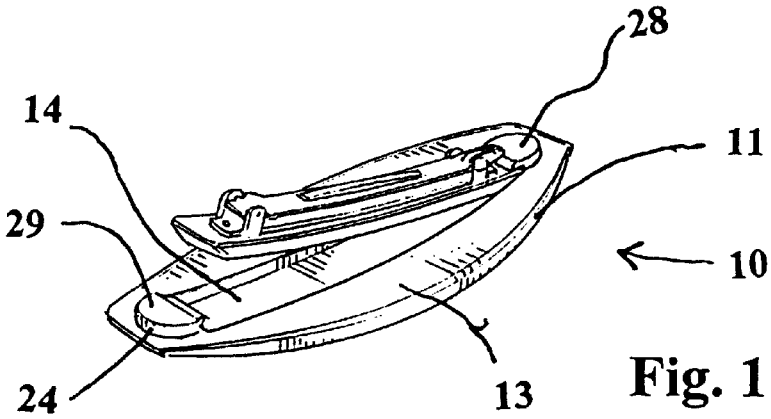
FIG. 11 illustrates the attachment of the clasp to the ornamental component according to the second preferred embodiment.
Figure 18:
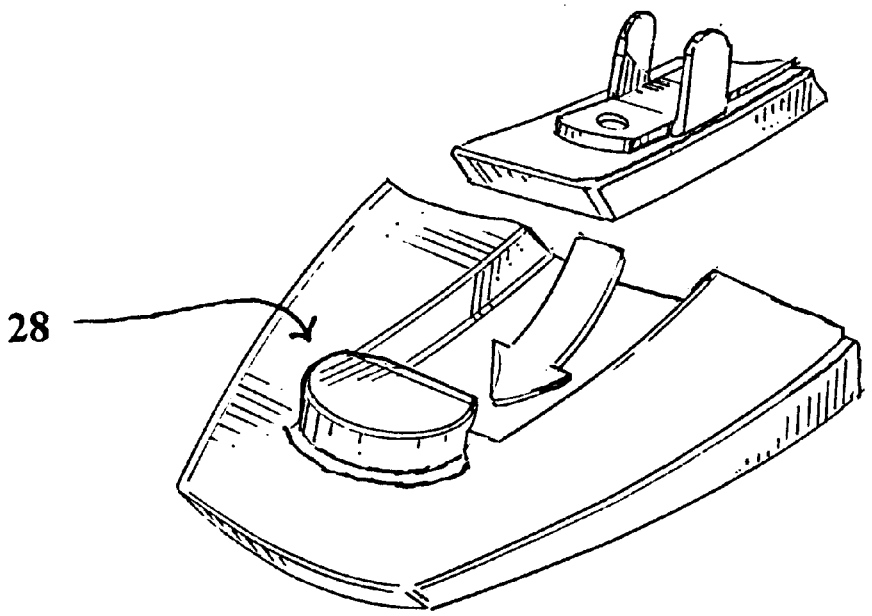
FIG. 18 depicts the direction of insertion of the universal adapter into the ornamental component according to the present invention.

When in use, one end of the removable clasp 50 of the present invention is inserted into the indentation 14 located in ornamental component 10 and underneath the projecting part of the cap section of a first post 28, as illustrated in FIG. 11 and FIG. 18. An opposite end of the removable clasp 50 is then forced downward, toward the ornamental component 10, until it engages the remaining post 29 of the pair of posts 20. Further downward pressure forces the opposite end of the removable clasp 50 along the beveled slope on the cap section 22, thereby slightly straightening the curvature of the ornamental component 10, and allowing the opposite end of the removable clasp 50 to "snap" underneath the projecting part of the cap section 22 of the remaining post 29.

Figure 15:
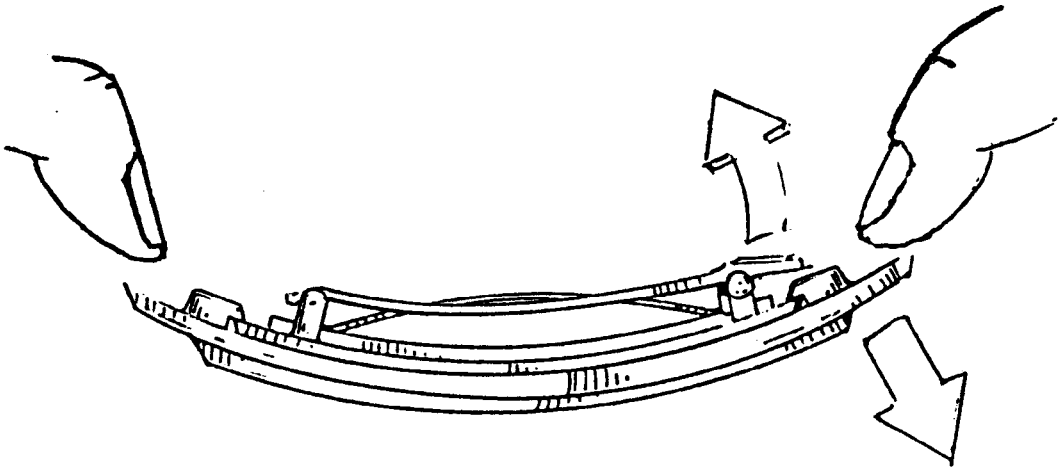
FIG. 15 illustrates one method of removal of the universal adapter from the ornamental component.

Release of the universal adapter 54 of the removable clasp 50 is accomplished by grasping the ornamental component 10 in two hands and bending it, thereby straightening its curvature. This forces the pair of posts 20 apart, and frees the universal adapter 54, as illustrated in FIG. 15.

Figure 16:
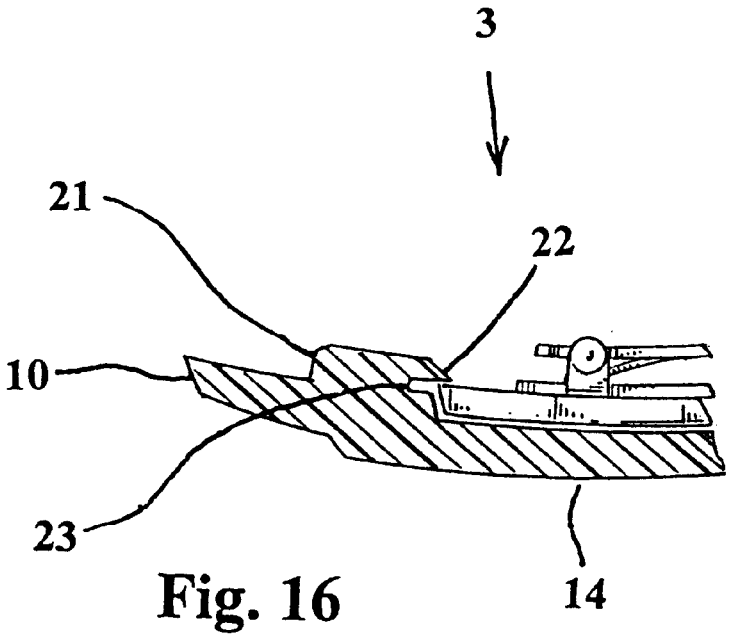
FIG. 16 is a side view of the third preferred embodiment with the ornamental component in cut-away.

In a third preferred embodiment 3, the body section 21 of the pair of posts 20 is placed a slight distance away from the edge of the indentation 14, thereby forming a hollow between the back side of the ornamental component 10, the flat side surface 23 of the body section 21 and the projecting part of the cap section 22, illustrated in FIG. 16. This hollow allows the projecting edge of the cap section 22 to flex downward without the necessity of significant projection over the indentation 14.

Figure 17:
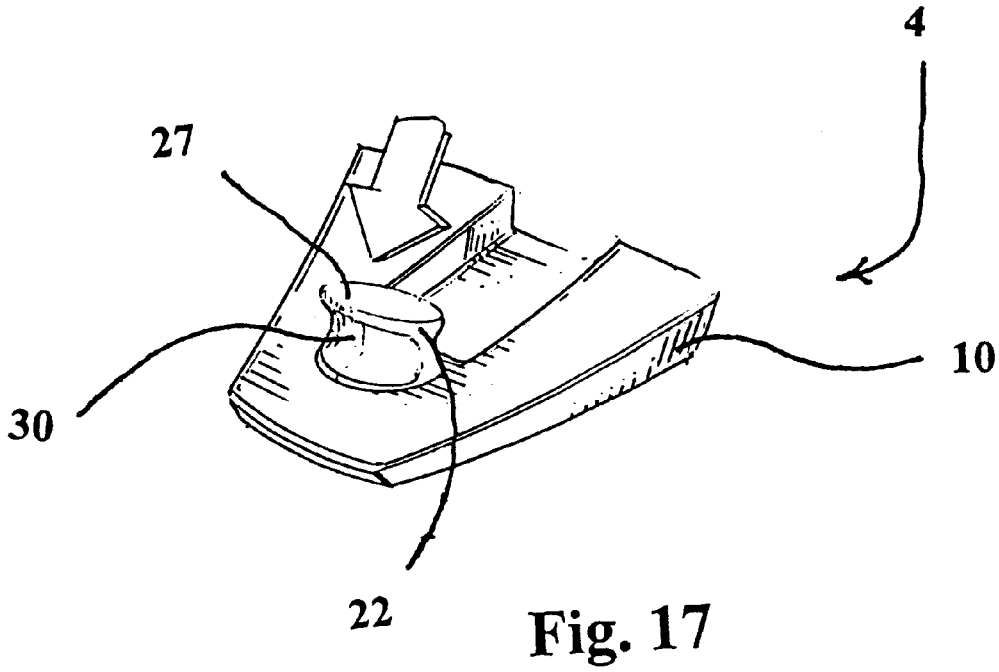
FIG. 17 illustrates the fourth preferred embodiment and the direction of force used to bend the pair of posts in order to remove the clasp from the ornamental component.

In a fourth preferred embodiment 4, the body section 21 of the pair of posts 20 has a channel 30 formed opposite of the flat side surface 23. Additionally, the entire cap top surface 27 of the top section 21 is sloped downward toward the indentation 14, FIG. 17.

This provides a convenient release mechanism which does not necessitate flexation of the ornamental component 10 to release the universal adapter 54. In order to release the universal adapter using the mechanism of the fourth preferred embodiment 4, force is applied to the cap top surface 27, toward the channel 30, illustrated in FIG. 17 by a force arrow. The application of force on the cap section 22 of the fourth preferred embodiment 4 bends the cap section 22 back and raises the flat side surface 25, thus freeing the universal adapter 54.

Figure 19:
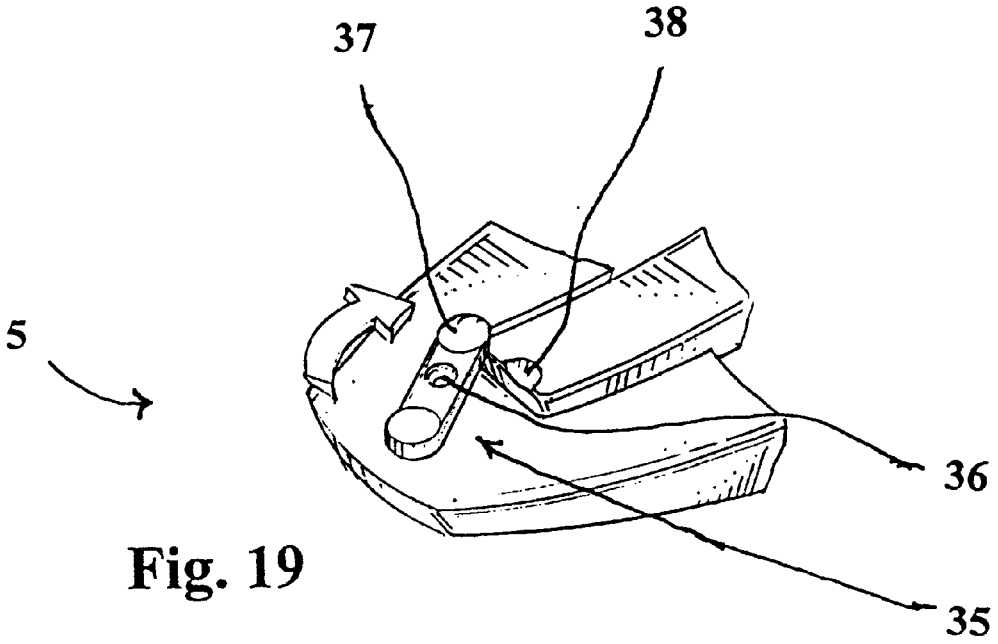
FIG. 19 illustrates the fifth preferred embodiment of the present invention.

In a fifth preferred embodiment 5, the removable clasp 50 is secured to the ornamental component 10 not by a pair of posts 20, but by pair of rotatable arms 35. As illustrated in FIG. 19, the pair of rotatable arms 35 are rotationally secured to the ornamental component at a central point 36. Each rotatable arm has two identical ends with upper 37 and lower projections (not shown). These projections form a knob at each end of the rotatable arm. Furthermore, the universal adapter 54 of the present preferred embodiment includes a quarter spherical depression 38 located at both the first and second ends. The upper projection 37 provides a surface upon which force is applied to swivel the pair of rotatable arms 35.

In use, the universal adapter 54 is placed within the indentation 14, the pair of rotatable arms 35 are swiveled over the universal adapter 54 to a position which places the lower projection in conjunction with the quarter spherical depression 38 located at each end of the universal adapter 54. To release the removable clasps 50, the pair of rotatable arms 35 are once again swiveled, thereby placing the knob on the back side 13 of the ornamental component 10.

It is understood that those skilled in the art may conceive modifications and/or variations to the specific embodiments shown and described herein. Any such modifications or variations which fall within the purview of this description are intended to be included therein as well. It is understood that the description herein in intended to be illustrative only and is not intended to be limitative. Rather, the scope of the invention described herein is limited only by the claims appended hereto.

What is claimed is:

1. An interchangeable barrette assembly comprising an ornamental component having a body section with a front side, a back side, and an indentation located on the back side of the ornamental component; and a removable clasp assembly comprising a clasp and a universal adapter attached to the clasp; whereby the removable clasp assembly is releasably securable to the back side of the ornamental component and the indentation included in the ornamental component substantially fits and receives the universal adapter, the ornamental component further comprises a pair of posts located at opposite ends of the indentation in the back side of the ornamental component, said pair of posts including a body section and a cap section, a cap portion partially projecting past the body section and over the indentation, the pair of posts further comprise:

a) the body section with a D-shape, having a flat side surface and a curved side surface;

b) the cap section with a D-shape, having a flat side surface and a curved side surface; and c) the flat side surface of the cap section projecting past the flat side surface of the body section thus creating a projecting part; and whereby the projecting part of the cap section holds the removable clasp assembly in place when it is located in the indentation.

2. An interchangeable barrette assembly as in claim 1 wherein the cap section has a bevel running from a top surface toward the flat side surface of the cap section.

3. An interchangeable barrette assembly as in claim 1 wherein the pair of posts are located a distance from the indentation sufficient to form a hollow defined by the back side of the ornamental component, the flat side surface of the body section and the projecting part of the cap section.

4. An interchangeable barrette assembly as in claim 1 wherein the pair of posts further include the body section with a channel in the curved side surface located opposite the flat side section and the cap section has a sloping top surface, wherein force may be applied to the sloping top surface of the cap section to bend the cap section away from the indentation thus securing or releasing the removable clasp assembly.

5. An interchangeable barrette assembly comprising an ornamental component having a body section with a front side, a back side, and an indentation located on the back side of the ornamental component, and a removable clasp assembly comprising a clasp and a universal adapter attached to the clasp; whereby the removable clasp assembly is releasably securable to the back side of the ornamental component and the indentation included in the ornamental component substantially fits and receives the universal adapter, the removable clasp assembly is further secured in the indentation by a pair of rotatable arms rotationally attached at opposite ends of the indentation.

6. An interchangeable barrette assembly as in claim 5 wherein the rotatable arms further comprise two opposing ends with upper and lower projections, and the universal adapter further comprises a depression at ends adjacent to the rotatable arms, whereby rotation of each rotatable arm places a lower projection located on one of the opposing ends in direct contact with the depression located at the end of the universal adapter adjacent the rotatable arm.

7. An interchangeable barrette assembly comprising an ornamental component having a body section with a front side, a back side, and an indentation located on the back side of the ornamental component; and a removable clasp assembly comprising a clasp and a universal adapter attached to the clasp; whereby the removable clasp assembly is releasably securable to the back side of the ornamental component and the indentation included in the ornamental component substantially fits and receives the universal adapter, the universal adapter further having a pair of tangs attached to a back side of the universal adapter and located in axial alignment with a pair of apertures formed in the clasp, wherein each of the pair of tangs further comprises a cylindrical body section and a frusto-conical cap section, said frusto-conical cap section having a small upper diameter and a large lower diameter.

8. An interchangeable barrette assembly as in claim 7 wherein each of the pair of tangs is split into two half sections by a channel.

9. An interchangeable barrette assembly comprising;

a) an ornamental component comprising a body section with a front side and a back side, an indentation which substantially fits and receives a universal adapter and which is located on the back side of the ornamental component, a pair of posts located at opposite ends of the indentation in the back side of the ornamental component, said pair of posts including a body section with a D-shape, having a flat side surface and a curved side surface and a cap section with a D-shape, having a flat side surface and a curved side surface, and having a bevel running from a top surface toward the flat side surface of the cap section, a cap portion partially projecting past the body section and over the indentation; and b) a removable clasp assembly comprising a clasp and a universal adapter attached to the clasp;

whereby the removable clasp assembly is releasably securable to the back side of the ornamental component.

* * * * *